US008973282B2

(12) United States Patent
Mackay

(10) Patent No.: US 8,973,282 B2
(45) Date of Patent: Mar. 10, 2015

(54) SECONDARY LINT TRAP FOR RESIDENTIAL LAUNDRY DRYER

(75) Inventor: David Thomas Mackay, Langley (CA)

(73) Assignee: Ecco Heating Products Ltd., Langley, B.C. (CA)

( * ) Notice: Subject to any disclaimer, the term of this patent is extended or adjusted under 35 U.S.C. 154(b) by 710 days.

(21) Appl. No.: 12/708,689

(22) Filed: Feb. 19, 2010

(65) Prior Publication Data

US 2010/0139113 A1 Jun. 10, 2010

Related U.S. Application Data

(63) Continuation of application No. 11/467,059, filed on Aug. 24, 2006, now abandoned.

(51) Int. Cl.
*D06F 58/22* (2006.01)
*D06F 58/20* (2006.01)

(52) U.S. Cl.
CPC ..... *D06F 58/22* (2013.01); *D06F 58/20* (2013.01)
USPC ..... 34/85; 34/82; 34/79; 34/480

(58) Field of Classification Search
CPC ..... D06F 58/22; D06F 58/20
USPC ..... 34/82, 85, 79, 300, 480; 29/896.6, 29/896.62, 902; 96/58, 361, 362, 363, 96/390; 454/158
See application file for complete search history.

(56) References Cited

U.S. PATENT DOCUMENTS 2,403,416 A * 7/1946 Vandegriff ..... 55/478
2,738,028 A * 3/1956 Fago ..... 55/308
2,871,688 A 2/1959 Geldhof
3,487,624 A 1/1970 Tignanelli
3,847,175 A 11/1974 Anderson
3,889,392 A 6/1975 Davis et al.
3,999,304 A 12/1976 Doty
4,137,647 A 2/1979 Clark, Jr.
4,434,564 A * 3/1984 Braggins, Jr. ..... 34/82
4,653,200 A 3/1987 Werner
4,819,341 A 4/1989 Gayso
5,145,217 A * 9/1992 Anderson et al. ..... 285/179

(Continued)

OTHER PUBLICATIONS

Brochure for LT-250-45 entitled "Lint Trap Surface or Drywall Mounted with no Rough Edges" by Reversomatic Manufacturing Limited dated Jul. 2002.

(Continued)

*Primary Examiner* — Kenneth Rinehart
*Assistant Examiner* — Tavia Sullens
(74) *Attorney, Agent, or Firm* — Davis Wright Tremaine LLP; George C. Rondeau, Jr.

(57) ABSTRACT

A secondary lint trap couplable between a laundry dryer and a building-embedded vent duct. The trap has an elongate housing. Aligned inlet and outlet apertures are formed in bottom and top sides of the housing's rearward ends. A tray is removably insertable within the housing. A screened aperture in the tray is aligned between the inlet and outlet apertures when the tray is inserted within the housing. The housing is mountable above the dryer such that the inlet and outlet apertures extend rearwardly of the dryer. This facilitates coupling of the dryer's exhaust outlet to the inlet aperture through one 90° elbow via a first short, substantially straight, elbowless conduit; and facilitates coupling of the vent duct to the outlet aperture through one other 90° elbow collar via a second short, substantially straight, elbowless conduit.

32 Claims, 3 Drawing Sheets

(56) References Cited

U.S. PATENT DOCUMENTS

| | | | | |
|---|---|---|---|---|
| 5,158,328 | A | 10/1992 | Anderson et al. | |
| 5,210,960 | A | 5/1993 | LaRue | |
| 5,236,478 | A | 8/1993 | Lewis et al. | |
| 5,524,358 | A | 6/1996 | Matz | |
| 5,675,908 | A | 10/1997 | Barnes | |
| 5,926,886 | A | 7/1999 | Braunschweig et al. | |
| 5,970,623 | A * | 10/1999 | Tuggle | 34/235 |
| 6,016,610 | A | 1/2000 | Sears | |
| 6,101,741 | A | 8/2000 | Sears | |
| 6,370,794 | B1 * | 4/2002 | Tuggle | 34/235 |
| 6,997,966 | B2 | 2/2006 | Iantorno | |
| 2005/0160708 | A1 | 7/2005 | Iantorno | |

OTHER PUBLICATIONS

Brochure for LT180 entitled "Lint Trap Surface Mounted" by Reversomatic Manufacturing Limited dated Sep. 1990.

Brochure for LT200 entitled "Lint Trap for Drywall Installation Ceiling or Wall Mounted" by Reversomatic Manufacturing Limited dated Mar. 1989.

Brochure for LT90 entitled "Lint Trap for Drywall Installation Ceiling or Wall Mounted" by Reversomatic Manufacturing Limited dated Oct. 2002.

Brochure for LT300 entitled "Lint Trap for Drywall Installation Ceiling or Wall Mounted" by Reversomatic Manufacturing Limited dated Sep. 1992.

Fantech Accessories Book dated Aug. 2004, Cover page, Index and p. 7 (DBLT4).

National HVAC Products, Inc., E-Z Clean Lint Trap Accessory Specification Sheet, date of publication or illustrated product availability to U.S. public is unknown, but illustrated product is alleged by opposing party in pending Canadian litigation to have been available to the public at least in Canada at least as early as Aug. 23, 2006.

Fantech DBLT4 Secondary Lint Trap Installation Instructions, Mar. 1, 2006, date of publication or illustrated product availability to U.S. public is unknown, but illustrated product is alleged by opposing party in pending Canadian litigation to have been available to the public at least in Canada at least as early as Aug. 23, 2006.

Photograph alleged to be the Lint Trap 250, date of publication or illustrated product availability to U.S. public is unknown, but illustrated product is alleged by opposing party in pending Canadian litigation to have been available to the public at least in Canada at least as early as Aug. 23, 2006.

Installation instructions (2 pages) for Fantech model DBF4XL fan depicting "secondary" lint trap. Oct. 2000.

Illustrations (9 pages) of lint traps available from Reversomatic Manufacturing Limited, Woodbridge, Ontario, Canada, 2006.

"Lint Trap for Dryer Boosting" web page specification for Fantech model DBLT 4, Fantech, Sarasota, FL, 2006.

Reversomatic Manufacturing Limited, Catalog page, Jun. 2008, LT-200-44, LT-200-45 www.reversomatic.com/brochures/LT-200-44, %20LT-200-45.pdf.

Reversomatic Manufacturing Limited, Catalog page, Jun. 2008, LT-250-45 www.reversomatic.com/brochures/LT-250-45.pdf.

Reversomatic Manufacturing Limited, Catalog page, Jun. 2008, LT-180, LT-180F www.reversomatic.com/brochures/LT-180, %20LT-180F.pdf.

Reversomatic Manufacturing Limited, Catalog page, Jun. 2008, LT-300-44, LT-300-45 www.reversomatic.com/brochures/LT-300-44, %20LT-300-45.pdf.

Reversomatic Manufacturing Limited, Catalog page, Jun. 2008, LT-90-44, LT-90-45 www.reversomatic.com/brochures/LT-90-44, %20LT-90-45.pdf.

Salerno, Joseph, President, Reversomatic Manufacturing Limited letter, Dec. 22, 2008.

* cited by examiner

SECONDARY LINT TRAP FOR RESIDENTIAL LAUNDRY DRYER

CROSS-REFERENCE TO RELATED APPLICATIONS

This application is a continuation of U.S. application Ser. No. 11/467,059 filed on 24 Aug. 2006 and entitled SECONDARY LINT TRAP FOR RESIDENTIAL LAUNDRY DRYER, the content of which is incorporated herein by reference.

TECHNICAL FIELD

This disclosure concerns a secondary lint trap for use with laundry dryers in residential building suites.

BACKGROUND

Modern multiple-suite high-rise residential buildings have ventilation systems with floor or ceiling-embedded vent ducts. Each suite has one or more vent ducts. Exhaust conduits are used to connect exhaust air sources within the suite to one of the vent ducts. Bathroom fans, range hood fans and laundry dryers are typical exhaust air sources. For example, one exhaust conduit may be connected between the exhaust outlet of a bathroom fan and a vent duct, a second exhaust conduit may be connected between the exhaust outlet of a range hood fan and a vent duct, a third conduit may be connected between the exhaust outlet of a laundry dryer and a vent duct, etc. Exhaust air is expelled into the conduits and exhausted from the building through the vent ducts.

Conventional residential laundry dryers have built-in primary lint traps. However, a dryer's damp, warm exhaust air may contain a substantial amount of excess lint which is not trapped by the dryer's primary lint trap. A secondary lint trap can be coupled between the dryer's exhaust outlet and the building's vent duct to reduce the accumulation of lint in the vent duct.

A stackable laundry washer/dryer unit 10 (FIG. 1) incorporating a dryer 12 stacked atop a washer 14 is often used to conserve space in a high-rise building suite. FIG. 1 depicts two alternative prior art configurations for coupling dryer 12 to one or the other of prior art secondary lint traps 16A, 16B. As shown to the right in FIG. 1, dryer 12's exhaust outlet 18 can be coupled through conduit 20A, 90° elbow 22A and conduit 24A to the inlet 26A of prior art secondary lint trap 16A. Secondary lint trap 16A's outlet 28A is coupled through conduit 30A and 90° elbow 32A to ceiling-embedded vent duct 34A. Alternatively, as shown to the left in FIG. 1, dryer 12's exhaust outlet 18 can be coupled through conduit 20B, 90° elbow 22B, conduit 21B, 90° elbow 23B and conduit 24B to the inlet 26B of prior art secondary lint trap 16B. Secondary lint trap 16B's outlet 28B is coupled through conduit 30B and 90° elbow 32B to ceiling-embedded vent duct 34B.

It is generally recommended that no more than two 90° elbows and no more than 15 feet of conduit be used to connect a laundry dryer's exhaust outlet to a building-embedded vent duct. Otherwise, air pressure in the exhaust conduit(s) and vent duct is reduced, resulting in inefficient operation of the dryer and potentially necessitating installation of an inline fan (not shown) to increase air pressure in the exhaust conduit(s) and vent duct. The prior art configuration shown to the right in FIG. 1 is somewhat preferable to the configuration on the left, because the configuration on the right has only two 90° elbows 22A, 32A whereas the configuration on the left has three 90° elbows 22B, 23B, 32B. The configuration on the right is also preferable if the combined length of conduits 20A, 24A and 30A is less than the combined length of conduits 20B, 21B, 24B and 30B; particularly if the combined length of conduits 20B, 21B, 24B and 30B exceeds 15 feet.

It is not always possible to adopt a 2-elbow configuration like that shown to the right in FIG. 1, nor is it always possible to adopt a configuration requiring no more than 15 feet of conduit to connect a dryer's exhaust outlet to a suite's built-in vent duct. This is problematic because if moisture-laden air is not efficiently exhausted, moisture may accumulate inside the elbows, exhaust conduit(s), vent duct, etc. potentially causing water damage. Moreover, if a prior art secondary lint trap is mounted in a location which is difficult to reach, the suite's occupant(s) may be unable or may be disinclined to remove accumulated lint from the secondary lint trap with sufficient frequency. Lint may accordingly accumulate in the secondary lint trap to a point which further reduces the dryer's efficiency. In an extreme case, accumulated lint can pose a fire hazard.

The foregoing examples of the related art and limitations related thereto are intended to be illustrative and not exclusive. Other limitations of the related art will become apparent to those of skill in the art upon a reading of the specification and a study of the drawings.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 2:
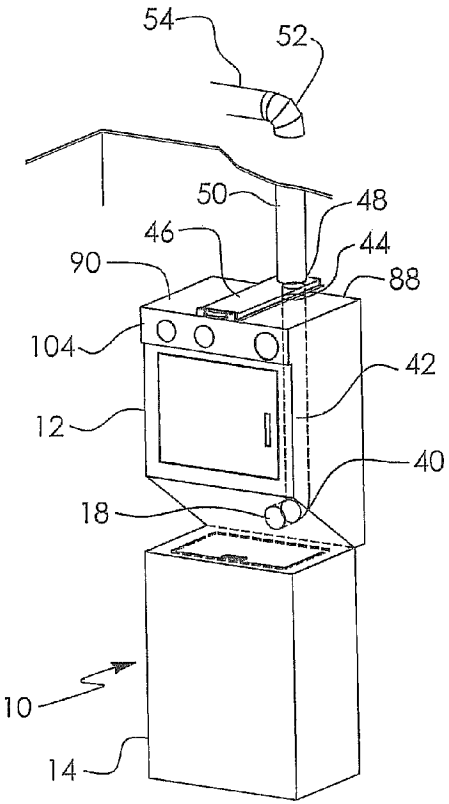
FIG. 2 is an isometric illustration depicting connection of a laundry dryer to a building-embedded vent duct through an improved secondary lint trap.
Figure 1:
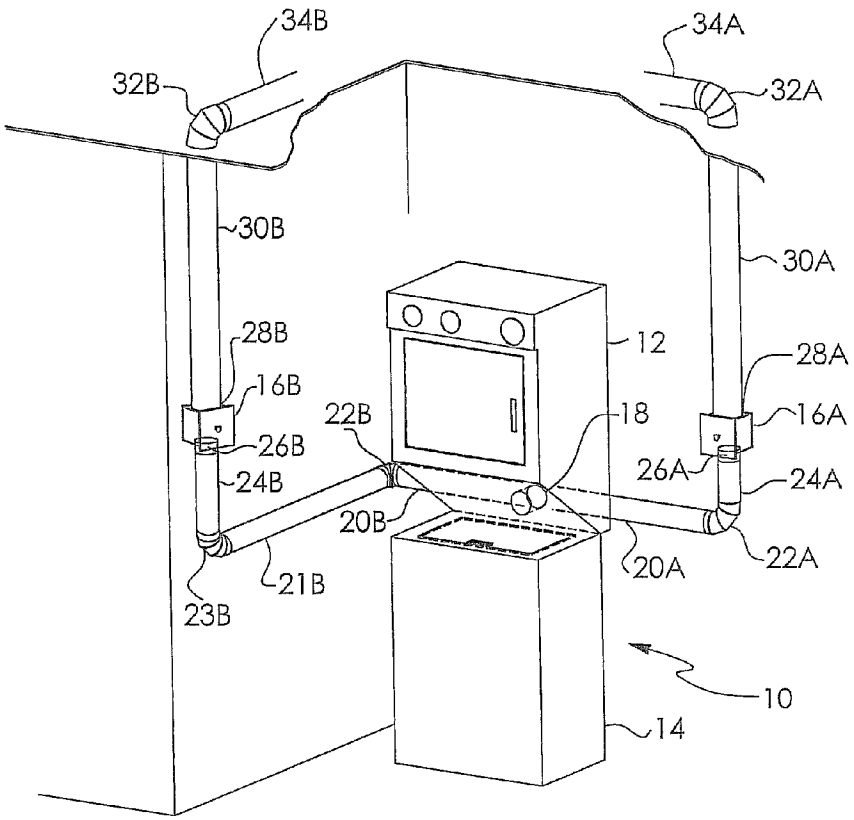
FIGURE 1 (PRIOR ART)
FIG. 1 is an isometric illustration depicting two alternative prior art configurations for connecting a laundry dryer through a prior art secondary lint trap to a building-embedded vent duct.

FIG. 2 depicts a stackable laundry washer/dryer unit 10 incorporating dryer 12 and washer 14 as described above in relation to FIG. 1. Dryer 12's exhaust outlet 18 is coupled through 90° elbow 40 and conduit 42 to the inlet collar 44 of secondary lint trap 46. Secondary lint trap 46's outlet collar 48 is coupled through conduit 50 and 90° elbow 52 to ceiling-embedded vent duct 54.

Figure 3:
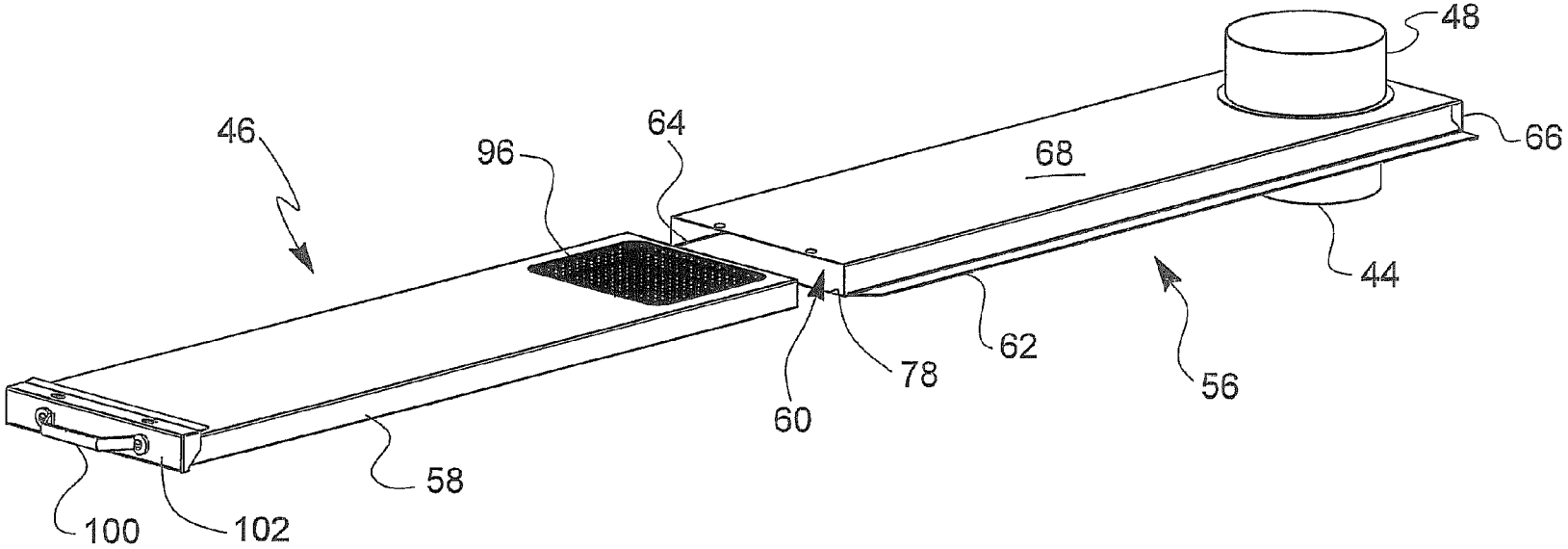
FIG. 3 is an enlarged isometric illustration of the FIG. 2 secondary lint trap.
Figure 4:
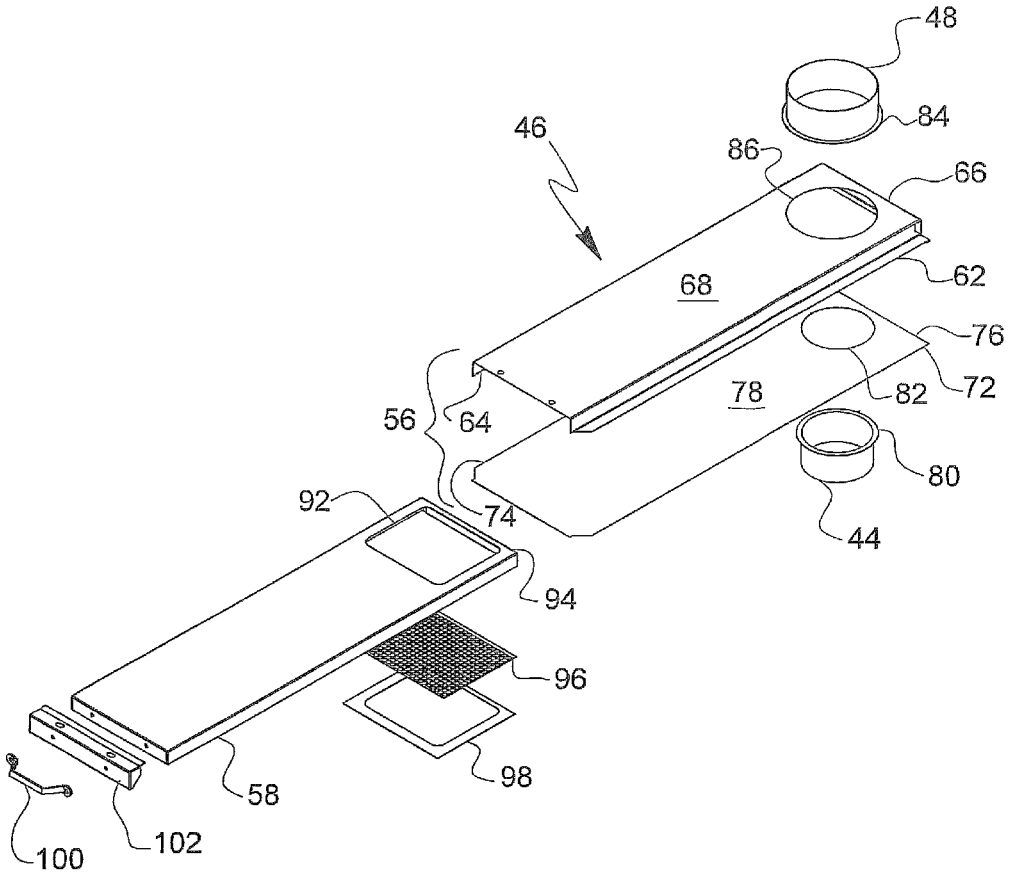
FIG. 4 is an exploded isometric illustration of the FIG. 3 secondary lint trap.

As best seen in FIGS. 3 and 4, secondary lint trap 46 includes an elongate housing 56 which slidably receives a flat, elongate removable tray 58 through frontal opening 60. Housing 56 may be formed by fastening the side and rear edges 62, 64, 66 of a channel-shaped, sheet metal top part 68 to the corresponding side and rear edges 72, 74, 76 of a flat, sheet metal bottom part 78. Top part 68 can be fastened to bottom part 78 by button-locking top part 68's side and rear edges 62, 64, 66 to bottom part 78's side and rear edges 72, 74, 76 respectively.

Inlet collar 44's flanged rim 80 is circumferentially fastened around bottom part 78's downward-facing inlet aperture 82 so that collar 44 protrudes downwardly from the bottom side of housing 56's bottom part 78. Inlet collar 44 and rim 80 are formed of sheet metal. Rim 80 may be welded around inlet aperture 82.

Outlet collar 48's flanged rim 84 is circumferentially fastened around top part 68's upward-facing outlet aperture 86 so that collar 48 protrudes upwardly from the top side of housing 56's top part 68. Outlet collar 48 and its rim 84 are formed of sheet metal. Rim 84 may be welded around outlet aperture 86.

Housing 56 is mounted atop dryer 12 such that inlet and outlet collars 44, 48 extend rearwardly of dryer 12's rear wall 88. Such rearward extension facilitates coupling of dryer 12's exhaust outlet 18 (which protrudes horizontally and rearwardly from dryer 12's rear wall 88) to inlet collar 44 through one 90° elbow 40 having an upward-facing outlet aligned with inlet collar 44 via one short, substantially straight, elbowless conduit 42. Such rearward extension also facilitates coupling of vent duct 54 to outlet collar 48 through one 90° elbow 52 having a downward-facing outlet aligned with outlet collar 48 via another short, substantially straight, elbowless conduit 50. Double-sided foam tape can be used to mount housing 56 atop dryer 12.

Tray 58 is sized and shaped for snug-fit, slidably removable insertion through housing 56's frontal opening 60. An aperture 92 is formed near the rearward end 94 of tray 58. Aperture 92 is aligned between apertures 82, 86 which are aligned with one another when top and bottom parts 68, 78 are assembled to form housing 56. Aperture 92 is thus aligned between inlet and outlet collars 44, 48 when tray 58 is fully inserted within housing 56. A stainless steel mesh screen 96 is mounted in aperture 92 by fastening apertured frame 98 over screen 96 and to the underside of tray 58, such that frame 98 circumferentially surrounds aperture 92. A handle 100 is provided on the forward end 102 of tray 58. The length of housing 56 and tray 58 (i.e. the displacement between housing 56's rear edges 66, 76 and the forward end 102 of tray 58) is sufficient to allow handle 100 to protrude slightly forwardly of dryer 12's front wall 104 when tray 58 is fully inserted within housing 56. This allows handle 100 to be easily grasped for removal of tray 58 from housing 56 as explained below.

During operation of dryer 12, lint-laden exhaust air is expelled horizontally and rearwardly through dryer 12's exhaust outlet 18 into and through 90° elbow 40, through conduit 42, through secondary lint trap 46's inlet collar 44, and through mesh screen 96—which traps lint. Lint-filtered exhaust air which passes through screen 96 flows through secondary lint trap 46's outlet collar 48, through conduit 50, through 90° elbow 52, into and through ceiling-embedded vent duct 54 which exhausts the air from the building.

After dryer 12 ceases operation, tray 58 can be slidably removed from housing 56 by grasping handle 100 and pulling tray 58 forwardly through frontal opening 60. Any lint trapped on screen 96 is removed. Tray 58 is then slidably replaced within housing 56 to realign screen 96 between inlet and outlet collars 44, 48.

As previously mentioned, a stackable laundry washer/dryer unit is often used to conserve space in a high-rise building suite. Sometimes, a relatively narrow closet is provided to house the washer/dryer unit. The closet may have insufficient room for mounting prior art secondary lint trap 16A or 16B in a conveniently accessible position within the closet. However, if prior art secondary lint trap 16A or 16B is mounted outside the closet, it may be necessary to use additional 90° elbows, or additional conduit, or both, to connect dryer 12's exhaust outlet 18 through prior art secondary lint trap 16A or 16B to a building-embedded vent duct, thus exacerbating the aforementioned inefficient dryer operation problem. Secondary lint trap 46 overcomes these shortcomings because secondary lint trap 46 can be mounted inside a narrow closet in a conveniently accessible position atop a stackable laundry washer/dryer unit housed inside the closet.

While a number of exemplary aspects and embodiments have been discussed above, those of skill in the art will recognize certain modifications, permutations, additions and sub-combinations thereof For example, although it may be convenient to mount housing 56 atop dryer 12, housing 56 may alternatively be mounted above dryer 12 provided inlet and outlet collars 44, 48 extend rearwardly of dryer 12's rear wall 88 to facilitate coupling of dryer 12's exhaust outlet 18 through one 90° elbow to inlet collar 44 via one short, substantially straight, elbowless conduit; and facilitate coupling of outlet collar 48 through one other 90° elbow to vent duct 54 via another short, substantially straight, elbowless conduit 50. As another example, although it may be convenient for handle 100 to protrude slightly forwardly of dryer 12's front wall 104 when tray 58 is frilly inserted within housing 56, handle 100 need only be sufficiently near front wall 104 to facilitate removal and reinsertion of tray 58 within housing 56. It is therefore intended that the following appended claims and claims hereafter introduced are interpreted to include all such modifications, permutations, additions and sub-combinations as are within their true spirit and scope.

What is claimed is:

1. A secondary lint trap for a laundry dryer, comprising:

(a) an elongate housing having a forward end and a rearward end;

(b) an inlet aperture in a bottom side of the rearward end of the housing;

(c) an outlet aperture in a top side of the rearward end of the housing, the outlet aperture aligned with the inlet aperture;

(d) a tray removably insertable within the housing, the tray having a screened aperture aligned between the inlet aperture and the outlet aperture when the tray is inserted within the housing; and (e) the housing mountable above the laundry dryer with the inlet aperture and the outlet aperture extending rearwardly of a rear wall of the laundry dryer and with the forward end of the housing nearer to a frontmost end of the laundry dryer than to a rearward end of the laundry dryer.

2. A secondary lint trap as defined in claim 1, the housing further comprising a top part fastened along side and rear edges to a bottom part.

3. A secondary lint trap as defined in claim 1, the housing further comprising a channel-shaped top part fastened along side and rear edges to a flat bottom part.

4. A secondary lint trap as defined in claim 1, wherein the housing is mountable atop the laundry dryer.

5. A secondary lint trap as defined in claim 1, wherein the laundry dryer is part of a stackable laundry washer and dryer unit.

6. A secondary lint trap as defined in claim 1, wherein the secondary lint trap is external to a building wall or ceiling.

7. A secondary lint trap as defined in claim 1 wherein the housing is at least twice as long as the housing is wide.

8. A secondary lint trap as defined in claim 1 wherein the forward end of the housing terminates at the frontmost end of the laundry dryer.

9. A secondary lint trap as defined in claim 1, wherein the tray is sized and shaped for snug-fit, slidably removable insertion through a frontal opening in the forward end of the housing.

10. A secondary lint trap as defined in claim 1 wherein the tray is shaped to substantially conform to an inner periphery of the housing to provide a snug-fit therein.

11. A secondary lint trap as defined in claim 1 wherein the tray is elongated and comprises a rearward portion having the screened aperture aligned between the inlet aperture and the outlet aperture when the tray is inserted within the housing and a forward portion extending from the rearward portion to adjacent the forward end of the housing.

12. A secondary lint trap as defined in claim 1, further comprising a handle on a forward end of the tray.

13. A secondary lint trap as defined in claim 12, wherein the handle is near the frontmost end of the laundry dryer when the tray is inserted within the housing and when the housing is mounted above the laundry dryer with the inlet aperture and the outlet aperture extending rearwardly of the rear wall of the laundry dryer.

14. A secondary lint trap as defined in claim 12, wherein the handle protrudes forwardly of the frontmost end of the laundry dryer when the tray is inserted within the housing and when the housing is mounted above the laundry dryer with the inlet aperture and the outlet aperture extending rearwardly of the rear wall of the laundry dryer.

15. A secondary lint trap as defined in claim 1, further comprising:

(a) an inlet collar fastened around the inlet aperture and protruding downwardly from the bottom side of the housing; and (b) an outlet collar fastened around the outlet aperture and protruding upwardly from the top side of the housing.

16. A secondary lint trap as defined in claim 15, the inlet collar having a first flanged rim fastened around the inlet aperture and the outlet collar having a second flanged rim fastened around the outlet aperture.

17. A secondary lint trap for a laundry dryer of a stackable laundry washer and dryer unit, comprising:

(a) an elongate housing having a forward end and a rearward end longitudinally opposed to the forward end;

(b) an inlet aperture in a bottom side of the rearward end of the housing;

(c) an outlet aperture in a top side of the rearward end of the housing, the outlet aperture aligned with the inlet aperture;

(d) a tray removably insertable within the housing, the tray having a screened aperture aligned between the inlet aperture and the outlet aperture when the tray is inserted within the housing; and (e) the housing mountable relative to the laundry dryer such that the forward end of the housing extends directly over the laundry dryer, the forward end is nearer to a frontmost end of the laundry dryer than to a rearward end of the laundry dryer and the inlet aperture and the outlet aperture extend rearwardly of a rear wall of the laundry dryer.

18. A secondary lint trap as defined in claim 17, wherein the housing is mountable such that the forward end of the housing terminates at the frontmost end of the laundry dryer.

19. A secondary lint trap as defined in claim 18, wherein the housing is mountable atop the laundry dryer.

20. A secondary lint trap for a laundry dryer of a stackable laundry washer and dryer unit, comprising:

(a) an elongate housing having a forward end and a rearward end longitudinally opposed to the forward end;

(b) an inlet aperture in a bottom side of the rearward end of the housing;

(c) an outlet aperture in a top side of the rearward end of the housing, the outlet aperture aligned with the inlet aperture;

(d) an inlet collar fastened around the inlet aperture and protruding downwardly from the bottom side of the housing;

(e) an outlet collar fastened around the outlet aperture and protruding upwardly from the top side of the housing;

(f) a tray removably insertable within the housing, the tray having a screened aperture aligned between the inlet aperture and the outlet aperture when the tray is inserted within the housing;

(g) the housing mountable above the laundry dryer with the inlet aperture and the outlet aperture extending rearwardly of a rear wall of the laundry dryer and with the forward end of the housing nearer to a frontmost end of the laundry dryer than to a rearward end of the laundry dryer; and (h) a handle on a forward end of the tray, wherein the handle is near the frontmost end of the laundry dryer when the tray is inserted within the housing and when the housing is mounted above the laundry dryer.

21. A secondary lint trap as defined in claim 20, wherein the housing is mountable atop the laundry dryer.

22. A secondary lint trap as defined in claim 20 wherein the forward end of the housing terminates at the frontmost end of the laundry dryer.

23. A secondary lint trap as defined in claim 20 wherein the tray is elongated and comprises a rearward portion having the screened aperture aligned between the inlet aperture and the outlet aperture when the tray is inserted within the housing and a forward portion extending from the rearward portion to adjacent the forward end of the housing.

24. A laundry washer and dryer unit, comprising:

(a) a laundry washer;

(b) a laundry dryer, wherein one of the laundry washer and the laundry dryer is mounted above the other and has a top surface with a frontmost end, a rearward end, and a rear wall; and (c) a secondary lint trap comprising:

(i) an elongate housing having a forward end and a rearward end;

(ii) an inlet aperture in a bottom side of the rearward end of the housing;

(iii) an outlet aperture in a top side of the rearward end of the housing, the outlet aperture aligned with the inlet aperture;

(iv) a tray removably insertable within the housing, the tray having a screened aperture aligned between the inlet aperture and the outlet aperture when the tray is inserted within the housing; and (v) the housing mountable above the top surface of the one of the laundry washer and the laundry dryer with the inlet aperture and the outlet aperture extending rearwardly of the rear wall of the top surface and with the forward end of the housing nearer to a frontmost end of the top surface than to a rearward end of the top surface.

25. A method of coupling a laundry dryer exhaust outlet of a laundry dryer to a building-embedded vent duct, the method comprising:

(a) providing a housing having a top side and a bottom side, an inlet aperture formed in the bottom side, and an outlet aperture formed in the top side and in alignment with the inlet aperture;

(b) providing a lint trapping screen removably mountable within the housing between the inlet aperture and the outlet aperture;

(c) mounting the housing above the laundry dryer with the inlet aperture facing downwardly and extending rearwardly of a rear wall of the laundry dryer and with the outlet aperture facing upwardly and extending rearwardly of a rear wall of the laundry dryer, and with a forward end of the housing nearer to a frontmost end of the laundry dryer than to a rearward end of the laundry dryer;

(d) coupling a first 90° elbow to the laundry dryer exhaust outlet;

(e) coupling a second 90° elbow to the vent duct;

(f) coupling a first conduit between an outlet of the first 90° elbow and the inlet aperture; and (g) coupling a second conduit between an inlet of the second 90° elbow and the outlet aperture.

26. A method as defined in claim 25, wherein mounting the housing above the laundry dryer comprises mounting the housing atop the laundry dryer.

27. A method as defined in claim 25, further comprising mounting the lint trapping screen in a tray slidably insertable within the housing.

28. A method as defined in claim 27, wherein the tray comprises a handle on a forward end of the tray.

29. A method as defined in claim 28, wherein the housing and the tray are sized such that the handle is near the frontmost end of the laundry dryer when the tray is inserted within the housing.

30. A method as defined in claim 28, wherein the housing and the tray are sized such that the handle protrudes forwardly of the frontmost end of the laundry dryer when the tray is inserted within the housing.

31. A method as defined in claim 25, wherein coupling the first 90° elbow to the laundry dryer exhaust outlet further comprises aligning the outlet of the first 90° elbow with the inlet aperture, and wherein coupling the second 90° elbow to the vent duct further comprises aligning the inlet of the second 90° elbow with the outlet aperture.

32. A method as defined in claim 31, wherein coupling the first conduit to the inlet aperture comprises coupling the first conduit to a downwardly protruding inlet collar fastened around the inlet aperture, and wherein coupling the second conduit to the outlet aperture comprises coupling the second conduit to an upwardly protruding outlet collar fastened around the outlet aperture.

* * * * *